US006618564B2

(12) United States Patent
Lange et al.

(10) Patent No.: US 6,618,564 B2
(45) Date of Patent: Sep. 9, 2003

(54) ELECTROPHOTOGRAPHIC DEVELOPMENT SYSTEM WITH CUSTOM COLOR PRINTING

(75) Inventors: Clark V. Lange, Ontario, NY (US); Daniel M. Bray, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/014,568

(22) Filed: Dec. 14, 2001

(65) Prior Publication Data

US 2003/0113135 A1 Jun. 19, 2003

(51) Int. Cl.[7] ..... G03G 15/01; G03G 15/08
(52) U.S. Cl. ..... 399/54; 399/223; 399/224
(58) Field of Search ..... 399/54, 222, 223–225, 399/265

(56) References Cited

U.S. PATENT DOCUMENTS 5,557,393 A 9/1996 Goodman et al.
5,722,008 A * 2/1998 Laing ..... 399/54
6,175,707 B1 * 1/2001 Eklund et al. ..... 399/265
6,463,239 B1 * 10/2002 Hays et al. ..... 399/222

* cited by examiner

*Primary Examiner*—William J. Royer
(74) *Attorney, Agent, or Firm*—Lloyd F. Bean, II

(57) ABSTRACT

An apparatus for developing a latent image recorded on an imaging surface with a custom color toner, including a developer housing for developing a portion of the latent image with the toner of custom color. The developer housing includes a donor member for transporting toner of the custom color to a development zone to develop the latent image. A replaceable reservoir unit is provided for mixing and supplying the custom color toner to the donor member. An array of toner dispensers is provided for supplying various primary color toners, as required, to achieve the custom color, and additional reservoirs having various colored toners therein to allow for faster convergence to a given point in the color space.

10 Claims, 2 Drawing Sheets

ELECTROPHOTOGRAPHIC DEVELOPMENT SYSTEM WITH CUSTOM COLOR PRINTING

BACKGROUND OF THE INVENTION

This invention relates generally to a development apparatus for ionographic or electrophotographic imaging and printing apparatuses and machines, and more particularly is directed to a developer apparatus for providing custom colored marking particles.

Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of customer selectable color output can be found in the field of "custom color", which specifically refers to registered proprietary colors, such as used, for example, in corporate logos, authorized letterhead, and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area.

Further, lines and text produced by halftone process color are very sensitive to misregistration of the multiple color images such that blurring, color variances, and other image quality defects may result. As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof.

This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions which have been mixed together to produce a customer selectable color output. Customer selectable color printing materials including paints, printing inks, and developing materials can be manufactured by determining precise amounts of constituent basic color components making up a given customer selectable color material, providing precisely measured amounts of each constituent basic color component, and thoroughly mixing these color components.

This process is commonly facilitated by reference to a color guide or swatch book containing hundreds or even thousands of swatches illustrating different colors, wherein each color swatch is associated with a specific formulation of colorants. Probably the most popular of these color guides is published by PANTONE®, Inc. of Moonachie, N.J. The PANTONE® Color Formula Guide expresses colors using a certified matching system and provides the precise formulation necessary to produce a specific customer selectable color by physically intermixing predetermined concentrations of up to four colors from a set of up to 18 principal or basic colors. There are many colors available using the PANTONE® system or other color formula guides of this nature that cannot be produced via typical halftone process color methods or even from mixing selected amounts of cyan, magenta, yellow and/or black inks or developer materials.

In the typical operational environment, an electrostatographic printing system may be used to print various customer selectable color documents. To that end, replaceable containers of premixed customer selectable color developing materials corresponding to each customer selectable color are provided for each print job.

Replacement of the premixed customer selectable color developer materials or substitution of another premixed color between different print jobs necessitates operator intervention which typically requires manual labor and machine downtime, among other undesirable requirements. In addition, since each customer selectable color is typically manufactured at an off-site location, supplies of each customer selectable color printing ink must be separately stored for each customer selectable color print job.

SUMMARY OF THE INVENTION

There is provided an apparatus for developing a latent image recorded on an imaging surface with a custom color toner, including a developer housing for developing a portion of said latent image with the toner of custom color, said developer housing including a donor member for transporting toner and carrier of said custom color to a development zone, a replaceable reservoir unit for mixing and supplying said custom color toner and carrier to the donor member, an array of toner dispensers for supplying various primary color toners, as required, to achieve said custom color, and additional reservoirs to allow for faster convergence to a given point in the color space.

There is provided a custom color housing, containing a replaceable first reservoir for storing a supply of developer material comprising toner of a first color; other replaceable reservoirs for storing a supply of developer material comprising toner of other colors, said other reservoirs being interchangeable with said first reservoir in the housing; an array of dispensers for dispensing toner of other colors into said housing, said reservoirs including means for mixing toner of said first color and toner of said other colors together to form toner of a required custom color and a color controller, in communication with said dispensers, for determining appropriate amounts of toners of said other colors to be added to said housing to achieve the custom color.

DETAILED DESCRIPTION OF THE FIGURES

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
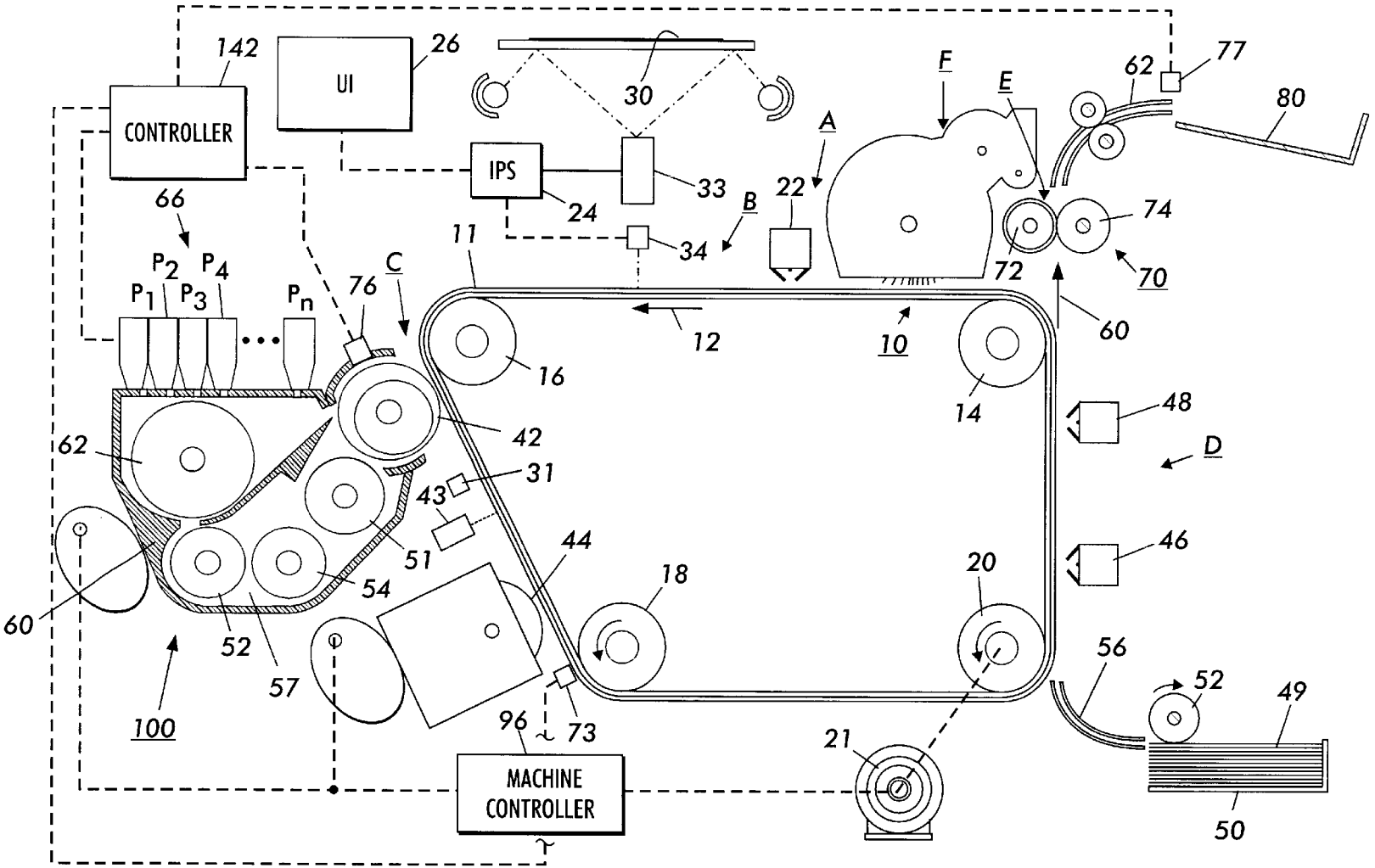
FIG. 1 is a schematic elevational view of an illustrative electrophotographic printing machine incorporating the present invention therein.

Turning now to FIG. 1, the electrophotographic printing machine uses a charge retentive surface in the form of a photoreceptor belt 10. The photoreceptor belt 10 is supported by rollers 14, 16, 18, and 20. A motor 21 operates the movement of roller 20, which in turn causes the movement of the photoreceptor belt 10 in the direction indicated by arrow 12, for advancing the photoreceptor belt 10 sequentially through the various xerographic stations.

With continued reference to FIG. 1, a portion of photoreceptor belt 10 passes through charging station A where a corona generating device, indicated generally by the reference numeral 22, charges the photoconductive surface of photoreceptor belt 10 to a relatively high, substantially uniform potential. For purposes of example, the photoreceptor belt 10 is negatively charged, however it is understood that the present invention could be useful with a positively charged photoreceptor belt 10, by correspondingly varying the charge levels and polarities of the toners, recharge devices, and other relevant regions or devices involved in the image on image color image formation process, as will be hereinafter described.

Next, the charged portion of the photoconductive surface is advanced through an imaging and exposure station B. A document 30, with a highlight color imagine and/or text original, is positioned on a raster input scanner (RIS), indicated generally by the reference numeral 33. One common type of RIS 33 contains document illumination lamps, optics, a mechanical scanning drive and a charged coupled device. The RIS captures the entire image from original document 30 and converts it to a series of raster scan lines. Alternatively, image signals may be supplied by a computer network. This information is transmitted as electrical signals to an image processing system (IPS), indicated generally by the reference numeral 24. IPS 24 converts image I formation into two colorant signals (i.e. black and the custom color). Alternatively, a highlight color image and/or a text original can be externally computer generated and sent to IPS 24 to be printed.

The IPS 24 contains control electronics which prepare and manage the image data flow to a raster output scanning device (ROS), indicated by numeral 34. A user interface (UI) indicated by 26 is in communication with IP 24. UI 26 enables an operator to control the various operator adjustable functions such as selecting a portion of the document to be printed with a custom color.

The operator actuates the appropriate keys of UI 26 to adjust the parameters of the copy. UI 26 may be a touch screen or any other suitable control panel providing an operator interface with the system. The output signal from UI 26 is transmitted to the IPS 24. The IPS 24 then transmits signals corresponding t the desired image to ROS 34, which creates the output copy image. ROS 34 includes a laser with rotating polygon mirror blocks. The ROS 34 illuminates, via mirror, the charged portion of the photoconductive surface 11 of the photoreceptor belt 10. The ROS 34 will expose the photoreceptor surface 11 to record single to multiple images which correspond to the signals transmitted from IPS 24.

The photoreceptor belt 10, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor belt 10 contains a monopolar voltage profile of high and low voltages, the former corresponding to charged areas and the latter corresponding to discharged or image areas.

A first development station C, indicated generally by the reference numeral 100, advances development material into contact with the electrostatic latent imagine. A development housing contains custom color toner and carrier. Appropriate developer biasing is accomplished via a power supply. Electrical biasing is such as to effect discharged area development (DAD) of the lower (less negative) of the two voltage levels on the photoreceptor belt 10 with the development material. This development system may be either a interactive or non-interactive system.

The photoconductive surface 11 is recharged by a corona device 31. A second exposure or imaging device 43 which may comprise a laser based output structure is utilized for selectively discharging the photoreceptor belt 10 on toned areas and/or bare areas to approximately −50 volts, pursuant to the image to be developed with a second color developer. After this point, the photoreceptor belt 10 contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material comprising, for example, a black toner is employed. The toner is contained in a developer housing structure 44 disposed at a second developer station and is presented to the latent images on the photoreceptor belt 10.

The photoreceptor belt 10 then advances the developed latent image to transfer station D. At transfer station D, a sheet of support material such as paper copy sheets, is advanced into contact with the developed latent images on the photoreceptor belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the photoreceptor belt 10, whereupon the sheet is stripped from the photoreceptor belt 10 by roller 14, which acts as a stripping roller.

Sheets of support material 49 are advanced to transfer station D from a supply tray 50. Sheets are fed from supply tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets 49. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheets 49, and such sheets 49 are directed via a chute 62 to an output 80 or finisher.

Residual particles, remaining on the photoreceptor belt 10 after each copy is made, are removed at cleaning station F.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

It is believed that the foregoing description is sufficient for purposes of the present application to illustrate the general operation of an electrophotographic printing machine incorporating the development apparatus of the present invention therein.

Figure 2:
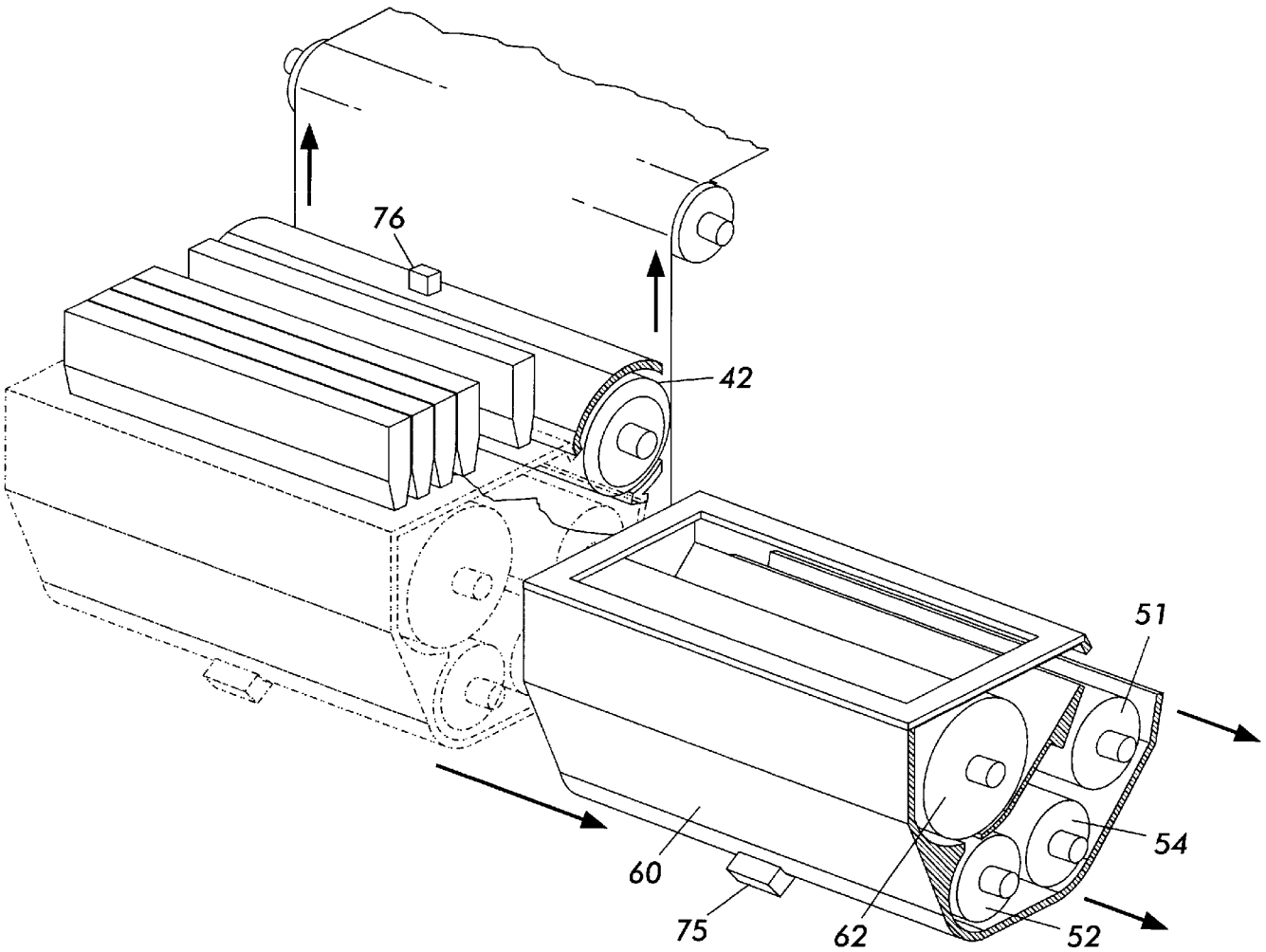
FIG. 2 is a schematic illustration of the development system according to the present invention.

Focusing on the development station C before describing the color mixing and control system of the present invention, in the exemplary developing apparatus of FIGS. 1 and 2 preferably the developing apparatus employs MAZE (magnetically agitated zone). Donor member 42 comprises an interior rotatable harmonic multiple magnetic assembly core within a sleeve. The sleeve ca be rotated in either the "with " or "against" direction relative to the direction f motion of the photoreceptor belt 10. Similarly, the magnetic core can be rotated in either the "with" or "against" direction relative to the direction of motion of the sleeve and developing material is transported from a supply sump 57 to the donor member 42 via a transport roll 51. Supply sump 57 acts as a holding receptacle for providing an operative solution of developing material comprised of toner material and carrier, which, in the case of the customer selectable color application of the present invention, includes a lend of different colored marking particles on a common carrier. Preferably color marking particles are Emulsion Aggregation or Chemical Toners (EA) toners, but in principle could be toner particles made from any variety of methods. Applicants have found good multi-toner blending using EA toners.

In accordance with the present invention, a plurality of replaceable supply dispensers 66 ($P_1$ through $P_n$), each containing a concentrated supply of marking particles corresponding to a basic color component in a color matching system, are provided in association with the operational supply sump 57. Housing 60 includes blender 62 and blends the basic color component together which is then released into supply sump 57. Augers 52 and 54 transport developer material to transport roll 51. Housing 60 is removable from development station 100.

In operation, the application of marking particles to the latent image, clearly depletes the overall amount of the operative solution of developing material in supply sump 57. Therefore, supply sump 57 is continuously replenished, as necessary, by the addition of developing material or selective components thereof from dispensers 66. Since the total amount of any one component making up the developing material utilized to develop the image may vary as a function of the area of the developed image areas and the background portions of the latent image on the photoconductive surface 11, the specific amount of each component of the developing material which must be added to the supply sump 57 varies with each development cycle.

For example, a print job having a developed image having a large proportion of printed image area will cause a greater depletion of marking particles from a developing material sump as compared to a print job having a developed image with a small amount of printed image area.

Systems have been disclosed in patent literature and otherwise for systematically replenishing developing material as they are depleted from the supply sump 57 during a development process. The present invention, however, contemplates a developing material replenishing system capable of systematical replenishing individual color components making up a customer selectable color developing material composition.

As such, the replenishment system of the present invention includes a plurality of differently colored developing material replaceable supply dispensers p1 through pn, each coupled to the operative supply sump 57. Preferably, each supply dispenser $P_1$ through $P_n$ contains a developing material of a known basic or primary color such as Cyan, Magenta, Yellow and Black. In one specific embodiment, the replenishment system includes nine supply dispensers $P_1$ through $P_n$, wherein each supply container provides a different basic color developing material corresponding to the nine basic or constituent colors of the PANTONE® Color Matching System.

This embodiment contemplates that color formulations conveniently provided by the PANTONE® System can be utilized, as for example, by storage in a look up table, to produce thousands of desirable output colors and shades in a customer selectable color printing. Using this system, as few as two different color developing materials, from supply dispensers P2 and P3 or example, can be combined in supply sump 57 to expand the color gain of customer selectable colors far beyond the colors available via half tone aging techniques. An essential component of the developing material color mixing and control system of the present invention is a color control system A customer selectable color mixing controller 142 is provided in order to determine appropriate amounts of each color developing material in supply dispensers P1 through Pn to be added to supply sump 57 to achieve the custom color, and to controllably supply each of such appropriate amounts of developing material.

Controller 142 may take the form of any known microprocessor based memory and processing device, as are well known in the art. The approach provided by the color mixing control system of the present invention includes a sensing device 76, for example, an optical sensor for monitoring the output color of the developer layer on donor member 42, a sensor 73, 76, and 77 monitoring the output color on the donor member 42, photoconductive surface, and fused paper sheet, respectively. A toner concentration sensor 75 used in conjunction with a pixel counter. These sensors are connected to controller 142 for providing sensed color information thereto, which, in turn is used for controlling the flow of the variously colored replenishing developing materials from dispensers 66. The colored developing materials in dispensers 66 correspond to the basic constituent colors of a color matching system, and are selectively delivered into the developing material supply sump 57 from each of the supply dispensers $P_1$ through $P_n$, to produce the customer selectable color output image.

An advantageous feature of the present invention is the replaceability of housing 60. This feature allows a quicker color change over for new print jobs requiring a new custom color substantially different from the prior job. Several housings 60 can be stored by an operator, for example, a set of 5 housings containing reddish colorant, bluish colorant, yellowish colorant, brownish colorant, and greenish colorant which would allow easier and faster color change over since these colorants are near the target color in color space.

When a change over is needed the donor member 42 and toner dispenser stay with the machine and the following sequence is performed:

The new custom color is requested (say red color associated with Xerox" digital stylized "X"). Sensing device 76 within development station 100 reads the color within or compares a new color with a previous color printed by the housing 60. If the new custom color is within the pre-set value color space value then the housing 60 (say housing having reddish colorant) is not removed.

If the custom color is outside the preset value color space for that housing 60 (say housing having bluish colorant) then the housing 60 is replaced. Prior to replacement, the donor member 42 can be "cleared" of developer by rotating donor member 42 without rotating transport roll 51. The material on donor member 42 will return to the blender 62. Since no new material is supplied by transport roll 51, donor member 42 will be cleared. Optionally, the color mixing controller 142 can return the housing 60 to be replaced to a preset value in its color space before housing 60 removal. The UI 26 indicates to the operator which housing 60 to install (i.e. housing having reddish colorant). The donor member 42 and transport roll 51 are cycled to load developer from the new supply sump 57. Next, customer selectable color mixing controller 142 is provided in order to determine appropriate amounts of each color developing material in supply dispensers P1 through Pn to be added to supply sump 57 to achieve the new required custom color.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface with a custom color toner, comprising:

a developer housing including a donor member for transporting toner of said custom color on an outer surface of said donor member to a development zone; a first reservoir for storing a supply of toner of said custom color;

a dispenser for dispensing toner of a first color and toner of a second color into said first reservoir to form said custom color, a color controller, in communication with said dispenser, for determining appropriate amounts of toner of said second color to be added to said first reservoir to achieve the custom color;

a second reservoir for storing a supply of toner, said second reservoir being interchangeable with said first reservoir.

2. The apparatus as recited in claim 1, wherein said second reservoir has toner of a third color therein.

3. The apparatus as recited in claim 1, wherein said color controller includes means for selecting said first reservoir or said second reservoir based upon a color space of said custom color and color space of toner in said first and second reservoir.

4. The apparatus as recited in claim 1, further including means for loading a toner layer of said custom color from said first or second reservoir onto said outer surface of said donor member.

5. The apparatus as recited in claim 4, wherein said first reservoir and said second reservoir each include an auger for mixing toner and said loading means.

6. The apparatus as recited in claim 4, wherein said dispenser includes an array of toner dispensers for supplying various primary color toners.

7. The apparatus as recited in claim 1, wherein said first reservoir and said second reservoir each include: a sensor for determining the color space of the toner present in the reservoir.

8. A housing for producing toner having a custom color, comprising:

a replaceable first reservoir for storing a supply of developer material comprising toner of a first color; other replaceable reservoirs for storing a supply of developer material comprising toner of other colors, said other replaceable reservoirs being interchangeable with said first reservoir in a housing; an array of dispensers for dispensing toner of other colors into said housing, said reservoirs including means for mixing toner of said first color and toner of said other colors together to form toner of said custom color; and a color controller, in communication with said dispensers, for determining appropriate amounts of toners of said other colors to be added to said reservoirs to achieve the custom color.

9. The custom color housing of claim 8, further comprising a donor member for transporting toner of said custom color on an outer surface of said donor member to a development zone.

10. A method of forming toner images having a custom color in a printing system having a development housing with a plurality of interchangeable reservoirs with each having toner of a different color, said method including the steps of:

selecting a custom color;

associating the selected custom color to a color space found in one of the plurality of interchangeable reservoirs; and inserting the associated one of the plurality of interchangeable reservoirs into the printing system.

* * * * *